US007148910B2

(12) United States Patent
Stauffer et al.

(10) Patent No.: US 7,148,910 B2
(45) Date of Patent: Dec. 12, 2006

(54) HIGH-SPEED PULSE WIDTH MODULATION SYSTEM AND METHOD FOR LINEAR ARRAY SPATIAL LIGHT MODULATORS

(75) Inventors: Donald J. Stauffer, Penfield, NY (US); Bradley W. VanSant, Macedon, NY (US)

(73) Assignee: Eastman Kodak Company, Rochester, NY (US)

( * ) Notice: Subject to any disclaimer, the term of this patent is extended or adjusted under 35 U.S.C. 154(b) by 262 days.

(21) Appl. No.: 10/702,854

(22) Filed: Nov. 6, 2003

(65) Prior Publication Data

US 2005/0099490 A1 May 12, 2005

(51) Int. Cl.
*B41J 2/47* (2006.01)

(52) U.S. Cl. ..... 347/239; 347/255

(58) Field of Classification Search ..... 347/144–145, 347/234, 248–25, 239–240, 251–255; 332/276, 332/109, 112; 359/290; 382/276; 345/204, 345/691, 694–698; 375/238–239, 242
See application file for complete search history.

(56) References Cited

U.S. PATENT DOCUMENTS 4,427,978 A 1/1984 Williams ..... 340/784
5,065,441 A * 11/1991 Yamamoto et al. ..... 382/276
5,250,939 A * 10/1993 Takanashi et al. ..... 345/204
5,278,652 A 1/1994 Urbanus et al. ..... 348/571
5,894,235 A 4/1999 Zimlich ..... 327/91
5,963,107 A * 10/1999 Nagano et al. ..... 332/109
5,990,923 A 11/1999 Morrison ..... 347/252
6,038,057 A 3/2000 Brazas, Jr. et al. ..... 359/291

(Continued)

FOREIGN PATENT DOCUMENTS

EP 0 712 245 A2 5/1996

OTHER PUBLICATIONS

"Grayscale Transformations of Cineon Digital Film Data for Display, Conversion, and Film Recording," Version 1.1, Apr. 12, 1993, pp. 1-22.

(Continued)

*Primary Examiner*—Hai Pham
(74) *Attorney, Agent, or Firm*—Stephen H. Shaw

(57) ABSTRACT

A high speed pulse width modulation system for driving a linear array spatial light modulator, including: a pixel-serial data source that provides at least one or more pixel-serial input data streams; a fundamental system clock signal; phase-shifted versions of the fundamental system clock signal; and a serial-to-parallel converter for converting the at least one or more pixel-serial input data streams into one or more pixel-parallel data streams. Also included is a decoder for decoding data of a single input pixel into at least two or more related pulse width modulation (PWM) signals, and a circuit for combining the at least two or more PWM signals into a single PWM signal capable of driving one of a plurality of inputs on a linear array spatial light modulator.

25 Claims, 3 Drawing Sheets

U.S. PATENT DOCUMENTS

| | | | | |
|---|---|---|---|---|
| 6,144,481 | A | 11/2000 | Kowarz et al. | 359/291 |
| 6,307,663 | B1 | 10/2001 | Kowarz | 359/231 |
| 6,678,085 | B1 | 1/2004 | Kowarz et al. | 359/291 |
| 6,717,714 | B1 * | 4/2004 | Kowarz et al. | 359/290 |
| 6,784,914 | B1 * | 8/2004 | Takaki et al. | 347/247 |
| 2002/0003533 | A1 | 1/2002 | Ooishi et al. | 345/204 |
| 2002/0080107 | A1 | 6/2002 | Fujimoto et al. | 345/87 |
| 2002/0130944 | A1 | 9/2002 | Ema et al. | 347/122 |
| 2003/0086177 | A1 | 5/2003 | Kowarz et al. | 359/618 |
| 2003/0086179 | A1 | 5/2003 | Kowarz et al. | 359/627 |
| 2004/0120025 | A1 * | 6/2004 | LeHoty | 359/290 |

OTHER PUBLICATIONS

David T. Amm et al., "Optical Performance of the Grating Light Valve Technology,"Photonics West-Electronic Imaging '99, Projection DisplaysV.

Marek W. Kowarz et al., "Conformal Grating Electromechanical System (GEMS) For High-Speed Digital Light Modulation," IEEE 15th International MEMS Conference 2002, pp. 568-573.

* cited by examiner

HIGH-SPEED PULSE WIDTH MODULATION SYSTEM AND METHOD FOR LINEAR ARRAY SPATIAL LIGHT MODULATORS

FIELD OF THE INVENTION

The invention relates generally to a display system containing one or more linear array spatial light modulators that generate a visible image from an electronic signal. More specifically, the invention relates to a method of high-speed pulse width modulation used to drive one or more linear array spatial light modulators in a display system.

BACKGROUND OF THE INVENTION

One of the most demanding aspects of a display system is its need to operate in real time. A display system must respond to an input data stream over which it has little or no control and must be capable of displaying information at a frame rate that is at least as fast as that input, if not faster. For progressive HDTV display, this can be up to 60 frames of 1920×1080 pixel data per second. Display systems capable of displaying full-resolution image frames from such an input must be capable of driving 2,073,600 pixels every 16.667msec. If the display system uses a full-frame spatial light modulator (SLM) such as Texas Instrument's Digital Micromirror Device™ (DMD), each pixel in the image can use the full 16.667msec to render its intensity level. For digital SLMs, a common method for rendering different intensity levels is to use pulse width modulation (PWM). A system using PWM divides up a fixed time interval, such as the frame refresh rate, into smaller blocks during which time the device is turned on and off. The eye integrates these on and off times to form an intermediate intensity level often referred to as grayscale. Studies have demonstrated (see for example, "Grayscale Transformations of Cineon Digital Film Data for Display, conversion, and Film Recording," v 1.1, Apr. 12, 1993, cinesite Digital Film Center, Hollywood, Calif.) that for true cinema-grade digital display systems, 14-bits of linear data are required to render the appropriate grayscale levels in an image. At a refresh rate of 60 frames per second, a display system using a full-frame or area array SLM requires a PWM clock frequency of approximately 1 MHz, a very realizable goal.

However, display systems employing linear array SLMs such as the conformal grating device detailed by Marek W. Kowarz in U.S. Pat. No. 6,307,663, issued Oct. 23, 2001, titled "Spatial Light Modulator With Conformal Grating Device," are much more demanding. For progressive HDTV display systems using linear array SLMs, each pixel has at most $1/1920^{th}$ of the source data frame rate during which time it must render the required intensity level. In fact, display systems using linear array SLMs are even more demanding as they must accommodate the overhead necessary for the scanning system to recover before displaying the next frame of data. For example, a scanning linear array SLM digital display system that has a 20% recovery time would require a PWM processing clock of approximately 2.4 GHz to render the required 14-bits of linear grayscale data. While a small handful of very specialized integrated circuits are capable of operating at such frequencies, most realizable systems are unable to operate at such high clock rates. There is a need, therefore, for high-speed PWM architectures for scanned linear array SLM display systems that can operate at speeds in excess of 1 GHz using currently available technology.

SUMMARY OF THE INVENTION

The above need is met according to the present invention by employing a high speed pulse width modulation system for driving a linear array spatial light modulator that includes a pixel-serial data source providing at least one or more pixel-serial input data streams; a clock for providing a fundamental system clock signal; a phase shifter providing at least one or more clock signals that are phase-shifted versions of the fundamental system clock signal; a serial-to-parallel converter for converting the at least one or more pixel-serial input data streams into one or more pixel-parallel data streams; a decoder for decoding data of a single input pixel into at least two or more related pulse width modulated (PWM) signals, wherein the at least two or more related PWM signals are synchronized to different edges of the fundamental clock signal and the at least one or more phase-shifted clock signals; and a circuit for combining the at least two or more related PWM signals into a single PWM signal capable of driving one of a plurality of inputs on a linear array spatial light modulator.

Another aspect of the present invention provides a method for driving high speed pulse width modulation signals within a fixed time period corresponding to a scanned linear array spatial light modulator, including the steps of: providing a fundamental clock signal; forming a phase-shifted clock signal from the fundamental clock signal; synchronizing the fundamental clock signal and the phase-shifted clock signal as an overall system clock having at least four or more clock edges; and using the at least four or more clock edges of the overall system clock to drive the high speed pulse width modulation signals within the fixed time period corresponding to the scanned linear array spatial light modulator.

DETAILED DESCRIPTION OF THE INVENTION

Multiple phase-shifted clocks and multiple pulse width modulation (PWM) signals per input signal are employed to form a single PWM output signal used to drive one of a plurality of inputs on a linear array spatial light modulator. This allows a display system to render the full image information at the required frame rate while maintaining reasonable system clock frequencies.

Figure 1:
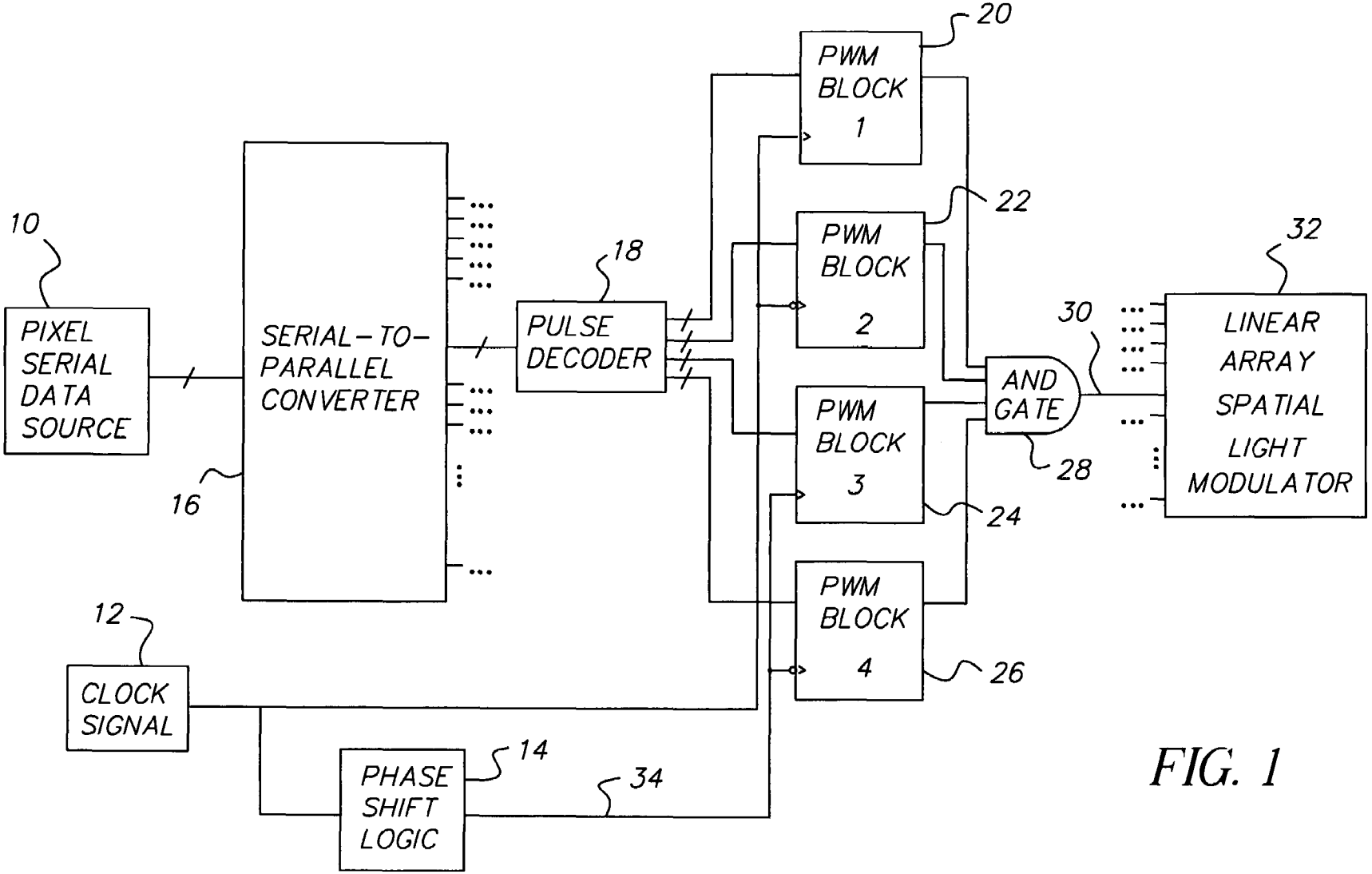
FIG. 1 is a block diagram of a high-speed pulse width modulation system for use in driving a scanned linear array spatial light modulator where the input to the linear array SLM is asynchronous.

FIG. 1 shows a block diagram of a high-speed pulse width modulation system that can be used to drive a scanned linear array spatial light modulator for display applications. The system accepts as input at least one stream of pixel-serial data source 10 connected to a serial-to-parallel converter 16. The serial-to-parallel converter 16 is used to store one complete line of data from a two-dimensional image. Each of the outputs of the serial-to-parallel converter 16 is connected to a pulse decoder block 18 which decodes the information for a single pixel into multiple PWM signals. In this particular implementation, four PWM signals 20, 22, 24, 26 are formed. A second system input is a fundamental clock signal 12. This clock signal 12 is passed through phase-shift logic 14 which delays the fundamental clock signal 12 by some specified amount. Both the fundamental clock signal 12 and the phase-shifted clock signal 34 are used in forming PWM signals. In this particular implementation, four clock edges are used: the rising and falling edges of both the fundamental clock signal 12 and a phase-shifted 34 version of this clock signal. Specifically, the rising edge of the fundamental clock signal 12 is used for 20, the falling edge of the fundamental clock signal 12 is used for 22, the rising edge of the phase-shifted clock signal 34 is used for 24, and the falling edge of the phase-shifted clock signal 34 is used for 26. The four PWM signals 20, 22, 24, 26 are combined using a 4-input AND gate 28. The output of the 4-input AND gate 28 defines a single PWM output signal 30 which is connected to one of the inputs on a linear array SLM device 32. The linear array SLM 32 can be an electromechanical conformal grating device such as that detailed by Kowarz in U.S. Pat. No. 6,307,663; an electromechanical grating light valve such as that detailed by David T. Amm et al. in "Optical Performance of the Grating Light Valve Technology," Photonics West-Electronic Imaging '99, Projection Displays V.; or some other linear array SLM. Because each of the four PWM signals 20, 22, 24, 26 are synchronous to different clock edges, the single PWM output signal 30 has resolution that is four times finer than the fundamental clock signal. In this implementation, the single PWM output signal 30 is asynchronously connected to the linear array SLM 32. It should be noted that for monochrome or color-sequential display systems, only a single linear array SLM is required to render the full image content. However, for color-simultaneous systems, two or more SLMs are required to render the full image content.

Figure 2:
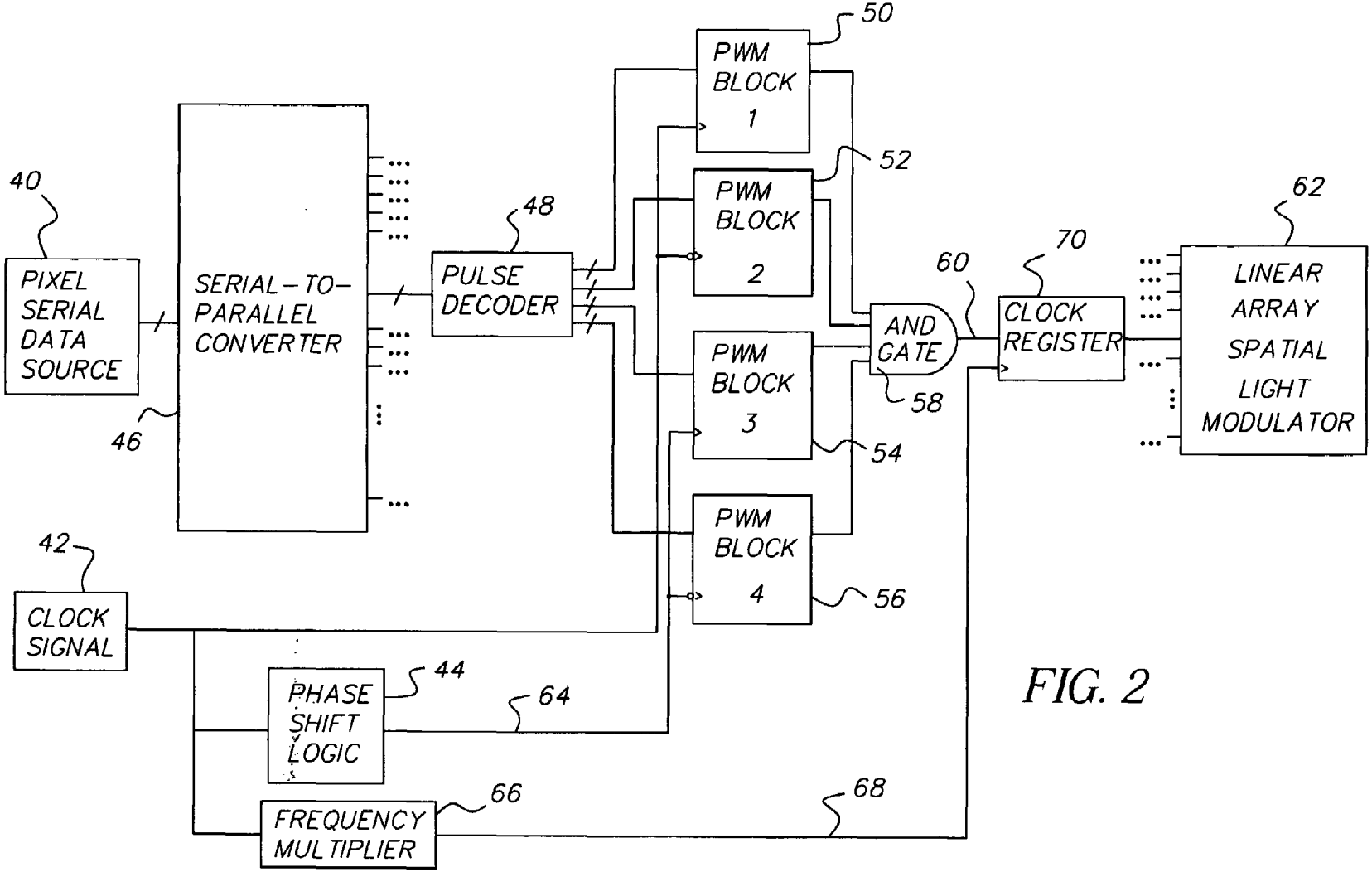
FIG. 2 is a block diagram of a high-speed pulse width modulation system for use in driving a scanned linear array spatial light modulator where the input to the linear array SLM is synchronous.

FIG. 2 shows a block diagram of a high-speed pulse width modulation system that can be used to drive a scanned linear array spatial light modulator for display applications. The system accepts as input at least one stream of pixel-serial data 40 connected to a serial-to-parallel converter 46. The serial-to-parallel converter 46 is used to store one complete line of data from a two-dimensional image. Each of the outputs of the serial-to-parallel converter 46 is connected to a pulse decoder block 48 which decodes the information for a single pixel into multiple PWM words. In this particular implementation, four PWM signals 50, 52, 54, 56 are formed. A second system input is a fundamental clock signal 42. This clock signal 42 is passed through phase-shift logic 44 which delays the fundamental clock signal 42 by some specified amount. Both the fundamental clock signal 42 and the phase-shifted 44 clock signal are used in forming PWM signals. In this particular implementation, four clock edges are used to form the PWM signals: the rising and falling edges of both the fundamental clock signals and the phase-shifted clock signal. Specifically, the rising edge of the fundamental clock signal 42 is used for 50, the falling edge of the fundamental clock signal 42 is used for 52, the rising edge of the phase-shifted clock signal 64 is used for 54, and the falling edge of the phase-shifted clock signal 64 is used for 56. The four PWM signals 50, 52, 54, 56 are combined using a 4-input AND gate 58. This system also includes a frequency multiplier 66 that multiplies the frequency of the fundamental clock signal 42. The output of the frequency multiplier 66 is a high-speed clock signal used to clock register 70 to re-time the output PWM signal before it is sent to the linear array SLM 62. By re-timing the output PWM signal 60, ill-affects of unequal path lengths and logic delays are greatly alleviated. Although the high-frequency clock signal 68 must be quite fast to maintain the resolution of the output PWM signal, its only function is to drive the output register 70, a very realistic task. As in FIG. 1, the linear array SLM 62 can be an electromechanical conformal grating device such as that detailed by Marek W. Kowarz in U.S. Pat. No. 6,307,663, an electromechanical grating light valve such as that detailed by David T. Amm et al. in "Optical Performance of the Grating Light Valve Technology," or some other linear array SLM. It should be noted that for monochrome or color-sequential display systems, only a single linear array SLM is required to render the full image content. However, for color-simultaneous systems, two or more SLMs are required to render the full image content.

Figure 3:
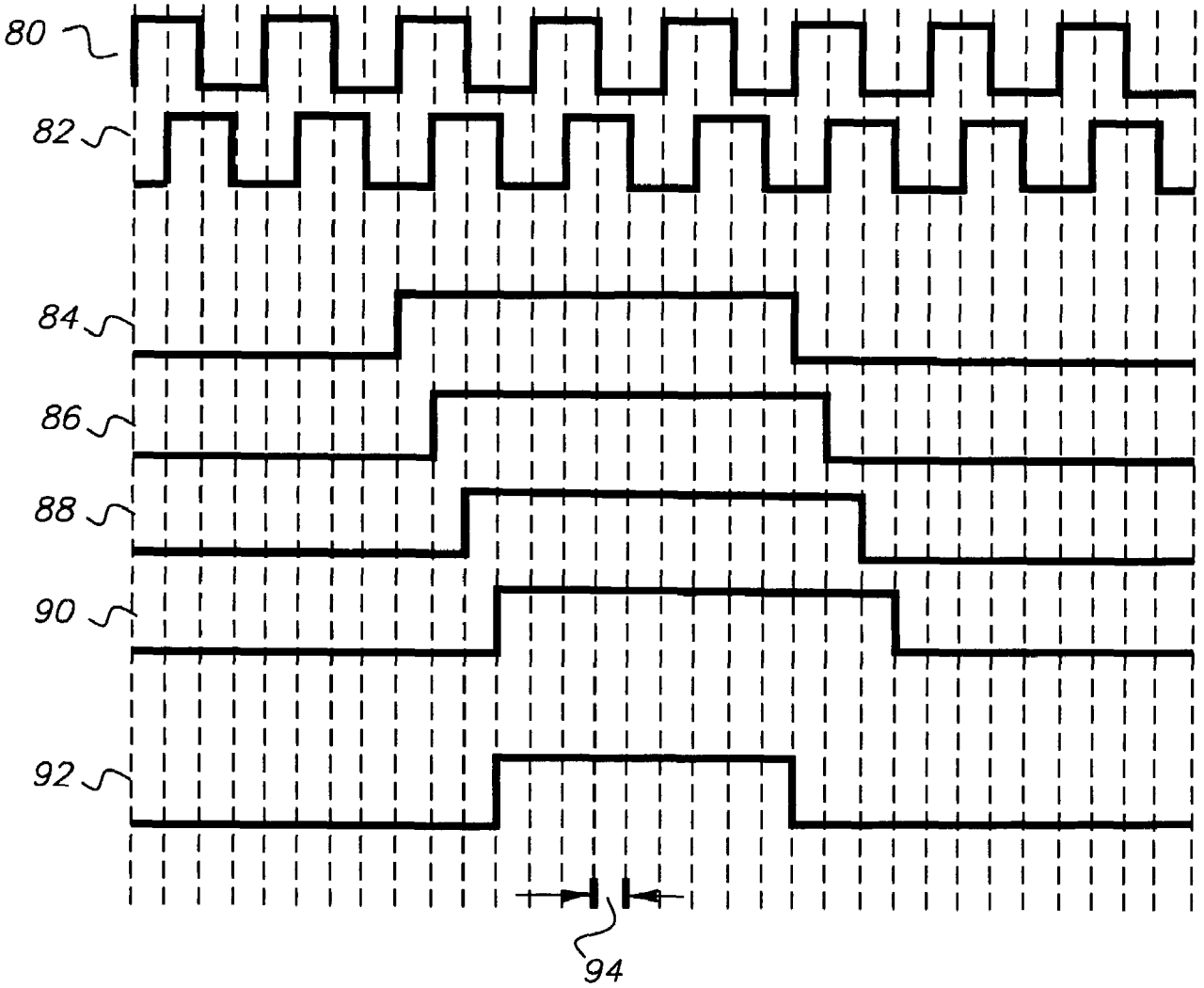
FIG. 3 is a timing diagram illustrating the use of multiple pulses to form a single output pulse having finer resolution than any one of the constituent pulses.

FIG. 3 shows a timing diagram for a high-speed pulse width modulation system employing a fundamental clock signal 80 and a 90° phase-shifted version of the fundamental clock signal 82. These two clock signals provide four distinct clock edges. Four pulse signals 84, 86, 88, 90 are synchronous to one of the four clock edges produced by 80 and 82. The intersection of these four pulses 92 defines a single output having resolution 94 equivalent to one-quarter of either clock signal 80 or 82. While this preferred embodiment shows four clock edges that fall symmetrically within the period of the fundamental clock signal 80, this need not be the case. It may be desired, for example, to skew certain clock edges relative to the fundamental clock signal 80 to correct for unequal path lengths or processing delays that arise when forming the PWM signals in an actual system.

The invention has been described with reference to a preferred embodiment; However, it will be appreciated that variations and modifications can be effected by a person of ordinary skill in the art without departing from the scope of the invention.

PARTS LIST

10 pixel-serial data source
12 fundamental clock signal
14 phase-shift logic
16 serial-to-parallel converter
18 pulse decoder
20 PWM signal
22 PWM signal
24 PWM signal
26 PWM signal
28 4-input and gate
30 single PWM
32 linear array spatial light modulator
34 phase-shifted clock signal
40 pixel-serial data source
42 fundamental clock signal
44 phase-shift logic
46 serial-to-parallel converter
48 pulse decoder
50 PWM signal
52 PWM signal
54 PWM signal
56 PWM signal
58 4-input and gate
60 PWM output signal
62 linear array spatial light modulator
64 phase-shifted clock signal
66 clock frequency multiplier
68 high-frequency clock signal Parts List—Continued

70 output register
80 fundamental clock signal
82 90° phase-shifted clock signal
84 intermediate PWM signal
86 intermediate PWM signal
88 intermediate PWM signal
90 intermediate PWM signal
92 output PWM signal
94 output PWM signal resolution

What is claimed is:

1. A high speed pulse width modulation system for driving a linear array spatial light modulator, comprising:

a) a pixel-serial data source providing at least one or more pixel-serial input data streams;

b) a clock for providing a fundamental system clock signal;

c) a phase shifter providing at least one or more clock signals that are phase-shifted versions of the fundamental system clock signal;

d) a serial-to-parallel converter for converting the at least one or more pixel-serial input data streams into one or more pixel-parallel data streams;

e) a decoder for decoding data of a single input pixel into at least two or more related pulse width modulation (PWM) signals, wherein the at least two or more related PWM signals are synchronized to different edges of the fundamental clock signal and the at least one or more phase-shifted clock signals; and f) a circuit for combining the at least two or more related PWM signals into a single PWM signal capable of driving one of a plurality of inputs on a linear array spatial light modulator.

2. The high speed pulse width modulation system claimed in claim 1 ,wherein the at least one or more phase-shifted versions of the fundamental system clock signal are equally spaced during a period of the fundamental system clock signal.

3. The high speed pulse width modulation system claimed in claim 1, wherein the at least one or more phase-shifted versions of the fundamental system clock signal are unequally spaced during a period of the fundamental system clock signal.

4. The high speed pulse width modulation system claimed in claim 1, wherein the at least two or more related PWM signals per pixel input data are formed using counters.

5. The high speed pulse width modulation system claimed in claim 1, wherein the at least two or more related PWM signals per pixel input data are formed using high-speed comparators.

6. The high speed pulse width modulation system claimed in claim 1, wherein the at least two or more related PWM signals are asynchronously combined into a single PWM signal.

7. The high speed pulse width modulation system claimed in claim 1, wherein the at least two or more related PWM signals are synchronously combined into a single PWM signal.

8. The high speed pulse width modulation system claimed in claim 1, wherein the linear array spatial light modulator is a conformal electromechanical grating device.

9. The high speed pulse width modulation system claimed in claim 1, wherein the linear array spatial light modulator is an electromechanical grating light valve.

10. The high speed pulse width modulation system claimed in claim 1, wherein a single linear array spatial light modulator is used.

11. The high speed pulse width modulation system claimed in claim 1, wherein two or more linear array spatial light modulators are used.

12. A high speed pulse width modulation system for driving a linear array spatial light modulator, comprising:

a) a pixel-serial data source providing at least one or more pixel-serial input data streams;

b) a clock for providing a fundamental system clock signal;

c) a phase shifter providing at least one or more clock signals that are phase-shifted versions of the fundamental system clock signal;

d) one or more decoders for decoding data of a single input pixel into at least two or more related pulse width modulation (PWM) signals, wherein the at least two or more related PWM signals are synchronized to different edges of the fundamental clock signal and the at least one or more phase-shifted clock signals; and e) a circuit for combining the at least two or more related PWM signals into a single PWM signal capable of driving one of a plurality of inputs on a linear array spatial light modulator.

13. The high speed pulse width modulation system claimed in claim 12, wherein the at least one or more phase-shifted versions of the fundamental system clock signal are periodically equally spaced.

14. The high speed pulse width modulation system claimed in claim 12, wherein the at least one or more phase-shifted versions of the fundamental system clock signal are periodically unequally spaced.

15. The high speed pulse width modulation system claimed in claim 12, wherein the at least two or more related PWM signals per pixel input data are formed using counters.

16. The high speed pulse width modulation system claimed in claim 12, wherein the at least two or more related PWM signals per pixel input data are formed using high-speed comparators.

17. The high speed pulse width modulation system claimed in claim 12, wherein the at least two or more related PWM signals are asynchronously combined into a single PWM signal.

18. The high speed pulse width modulation system claimed in claim 12, wherein the at least two or more related PWM signals are synchronously combined into a single PWM signal.

19. The high speed pulse width modulation system claimed in claim 12, wherein the linear array spatial light modulator is a conformal electromechanical grating device.

20. The high speed pulse width modulation system claimed in claim 12, wherein the linear array spatial light modulator is an electromechanical grating light valve.

21. The high speed pulse width modulation system claimed in claim 12, wherein a single linear array spatial light modulator is used.

22. The high speed pulse width modulation system claimed in claim 12, wherein two or more linear array spatial light modulators are used.

23. A method for driving high speed pulse width modulation signals within a fixed time period corresponding to a scanned linear array spatial light modulator, comprising the steps of:

a) providing a fundamental clock signal;

b) forming a phase-shifted clock signal from the fundamental clock signals wherein the phase-shifted clock signal is formed by unequally dividing the fundamental clock signal;

c) synchronizing the fundamental clock signal and the phase-shifted clock signal as an overall system clock having at least four or more clock edges; and d) using the at least four or more clock edges of the overall system clock to drive the high speed pulse width modulation signals within the fixed time period corresponding to the scanned linear array spatial light modulator.

24. A high speed pulse width modulation system for driving a linear array spatial light modulator, comprising:

a) a pixel-serial data source;

b) a means for generating a fundamental clock signal;

c) a means for forming a phase-shifted clock signal from the fundamental clock signal;

d) a pulse decoder for decoding output of the pixel-serial data source into multiple pulse width modulation signals;

e) a plurality of counters utilizing an output signal from the pulse decoder as an input and combining the fundamental clock signal and the phase-shifted clock signal as an overall system clock having at least four or more clock edges wherein each of the plurality of counters has an output; and f) a means for combining the plurality of counter output signals to form a single pulse width modulation output signal for driving a linear array spatial light modulator.

25. A method for driving high speed pulse width modulation signals within a fixed time period corresponding to a scanned linear array spatial light modulator, comprising the steps of:

a) providing a fundamental clock signal;

b) forming a phase-shifted clock signal from the fundamental clock signal;

c) synchronizing the fundamental clock signal and the phase-shifted clock signal as an overall system clock having at least four or more clock edges;

d) using the at least four or more clock edges of the overall system clock to drive the high speed pulse width modulation signals within the fixed time period corresponding to the scanned linear array spatial light modulator;

e) providing at least one or more pixel-serial input data streams;

f) converting the at least one or more pixel-serial input data streams into one or more pixel-parallel data streams;

g) outputting the one or more pixel-parallel data streams to a decoder;

h) decoding information of a single input pixel into at least two or more related pulse width modulation signals; and i) combining the at least two or more related pulse width modulation signals into a single pulse width modulation signal capable of driving the linear array spatial light modulator as an input.

* * * * *